US005775182A

United States Patent [19]

Plakinger

[11] Patent Number: 5,775,182

[45] Date of Patent: Jul. 7, 1998

[54] COMPOUND POWER SOCKET WRENCH

[76] Inventor: Frank J. Plakinger, Rte. 2 Box 167-E, Raymond, Wash. 98577

[21] Appl. No.: 666,206

[22] Filed: Jun. 18, 1996

[51] Int. Cl.[6] ..... B25B 17/00

[52] U.S. Cl. ..... 81/57.3; 81/180.1

[58] Field of Search ..... 81/57.3, 57.14, 81/172.2, 177.4, 177.5, 180.1

[56] References Cited

U.S. PATENT DOCUMENTS 3,714,852 2/1973 Giangrasso ..... 81/57.3
4,352,307 10/1982 Martinmaas ..... 81/177.4
4,506,567 3/1985 Makhlouf ..... 81/57.3

FOREIGN PATENT DOCUMENTS 2713940 11/1977 Germany ..... 81/57.3

*Primary Examiner*—James G. Smith

[57] ABSTRACT

A new Compound Power Socket Wrench System for facilitating removal and tightening of fasteners which are inaccessible to conventional tools. The inventive device includes a handle, a drive means within the handle, an extension means mechanically connected to the drive means, and an auxiliary drive handle removably engaging the extension means.

2 Claims, 3 Drawing Sheets

COMPOUND POWER SOCKET WRENCH

BACKGROUND OF THE INVENTION

1. Field of the Invention

The present invention relates to Wrench Devices and more particularly pertains to a new Compound Power Socket Wrench System for facilitating removal and tightening of fasteners which are inaccessible to conventional tools.

2. Description of the Prior Art The use of Wrench Devices is known in the prior art. More specifically, Wrench Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Wrench Devices include U.S. Pat. No. 4,611,514; U.S. Pat. No. 4,224,844; U.S. Pat. No. 4,098,151; U.S. Design Pat. No. 340,175; U.S. Pat. No. 4,116,093 and U.S. Pat. No. 3,987,691.

While these devices fulfill their respective, particular objectives and requirements, the aforementioned patents do not disclose a new Compound Power Socket Wrench System. The inventive device includes a handle, a drive means within the handle, an extension means mechanically connected to the drive means, and an auxiliary drive handle removably engaging the extension means.

In these respects, the Compound Power Socket Wrench System according to the present invention substantially departs from the conventional concepts and designs of the prior art, and in so doing provides an apparatus primarily developed for the purpose of facilitating removal and tightening of fasteners which are inaccessible to conventional tools.

SUMMARY OF THE INVENTION

In view of the foregoing disadvantages inherent in the known types of Wrench Devices now present in the prior art, the present invention provides a new Compound Power Socket Wrench System construction wherein the same can be utilized for facilitating removal and tightening of fasteners which are inaccessible to conventional tools.

The general purpose of the present invention, which will be described subsequently in greater detail, is to provide a new Compound Power Socket Wrench System apparatus and method which has many of the advantages of the Wrench Devices mentioned heretofore and many novel features that result in a new Compound Power Socket Wrench System which is not anticipated, rendered obvious, suggested, or even implied by any of the prior art Wrench Devices, either alone or in any combination thereof.

To attain this, the present invention generally comprises a handle, a drive means within the handle, an extension means mechanically connected to the drive means, and an auxiliary drive handle removably engaging the extension means.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Compound Power Socket Wrench System apparatus and method which has many of the advantages of the Wrench Devices mentioned heretofore and many novel features that result in a new Compound Power Socket Wrench System which is not anticipated, rendered obvious, suggested, or even implied by any of the prior art Wrench Devices, either alone or in any combination thereof.

It is another object of the present invention to provide a new Compound Power Socket Wrench System which may be easily and efficiently manufactured and marketed.

It is a further object of the present invention to provide a new Compound Power Socket Wrench System which is of a durable and reliable construction.

An even further object of the present invention is to provide a new Compound Power Socket Wrench System which is susceptible of a low cost of manufacture with regard to both materials and labor, and which accordingly is then susceptible of low prices of sale to the consuming public, thereby making such Compound Power Socket Wrench System economically available to the buying public.

Still yet another object of the present invention is to provide a new Compound Power Socket Wrench System which provides in the apparatuses and methods of the prior art some of the advantages thereof, while simultaneously overcoming some of the disadvantages normally associated therewith.

Still another object of the present invention is to provide a new Compound Power Socket Wrench System for facilitating removal and tightening of fasteners which are inaccessible to conventional tools.

Yet another object of the present invention is to provide a new Compound Power Socket Wrench System which includes a handle, a drive means within the handle, an extension means mechanically connected to the drive means, and an auxiliary drive handle removably engaging the extension means.

Still yet another object of the present invention is to provide a new Compound Power Socket Wrench System that allows the user to remove and tighten fasteners in normally inaccessible locations.

Even still another object of the present invention is to provide a new Compound Power Socket Wrench System that increases the user's performance when constructing mechanical products.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
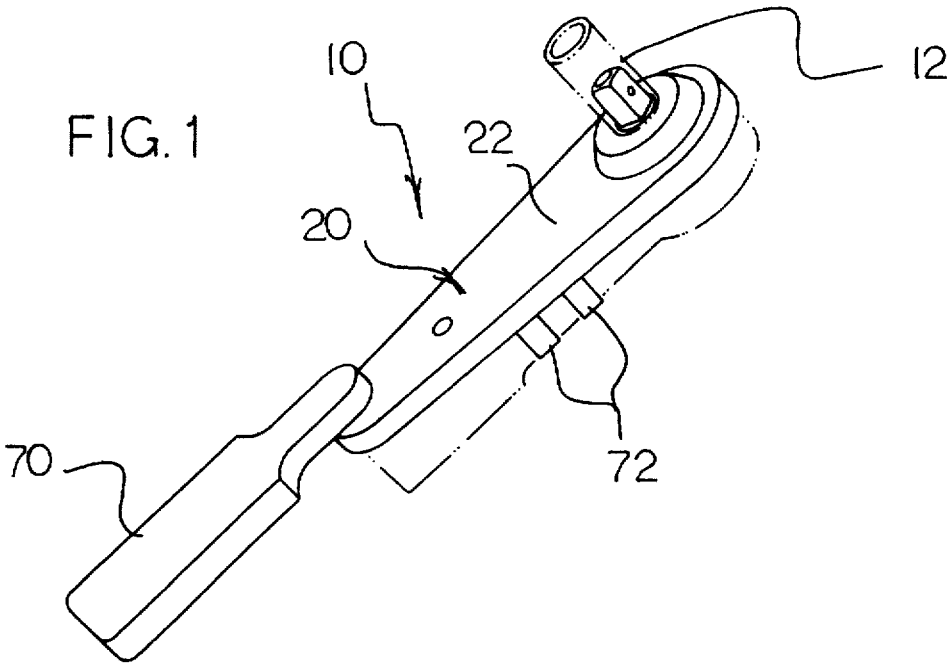
FIG. 1 is a side perspective view of a new Compound Power Socket Wrench System showing the stud member coupled to a standard socket and the auxiliary drive handle engaging the extension means according to the present invention.
Figure 2:
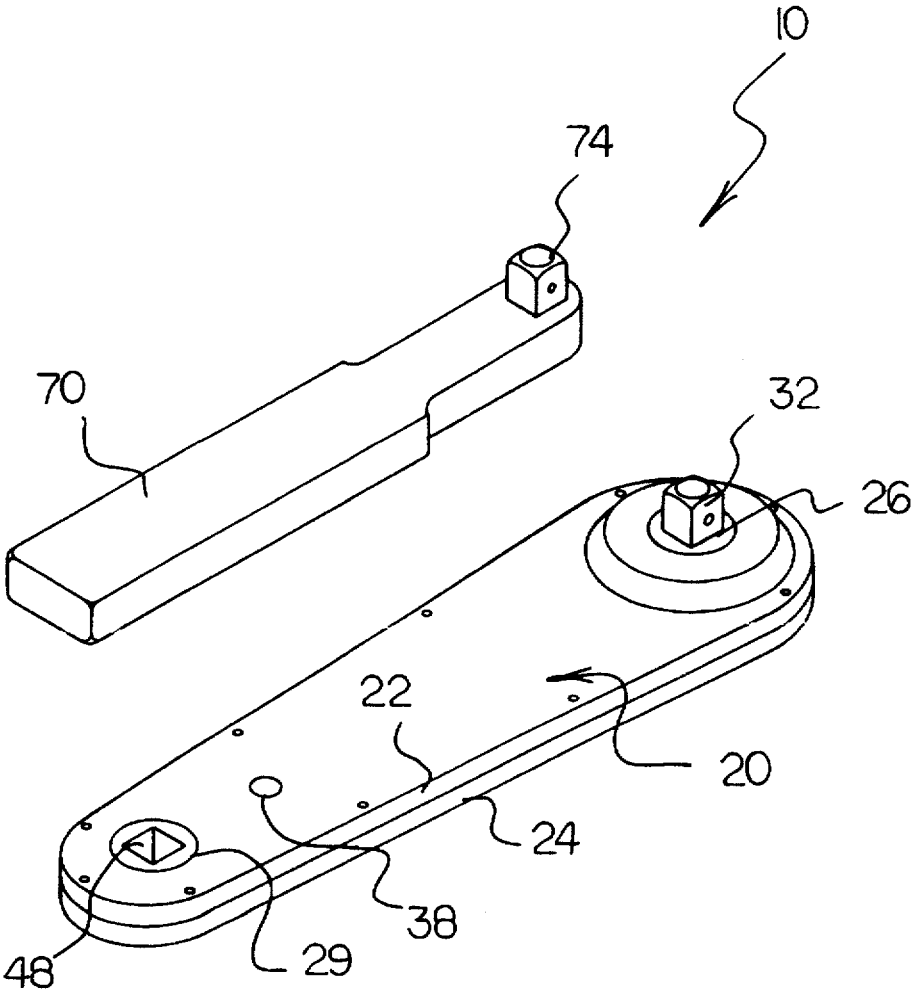
FIG. 2 is a perspective view of the present invention.

With reference now to the drawings, and in particular to FIGS. 1 through 6 thereof, a new Compound Power Socket Wrench System embodying the principles and concepts of the present invention and generally designated by the reference numeral 10 will be described.

More specifically, it will be noted that the Compound Power Socket Wrench System 10 comprises a handle 20 formed in an elongated elliptical shape, a drive means 30 positioned within the handle 20 near one end, an extension means 40 positioned within the handle 20 near the end opposite of the drive means 30, and an auxiliary drive handle 70 engaging the extension means 40.

Figure 3:
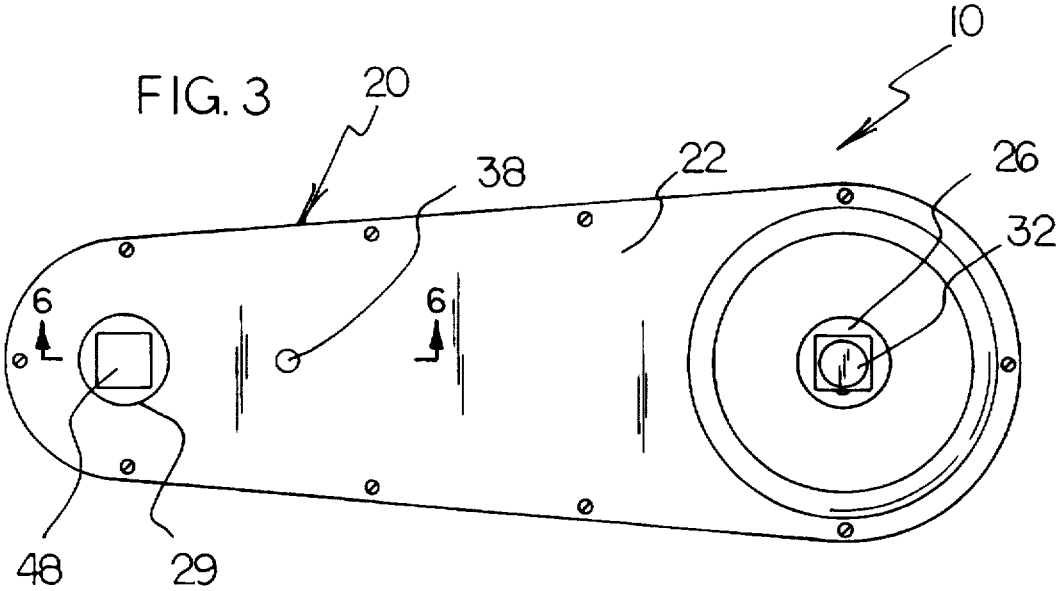
FIG. 3 is a front view of the present invention.
Figure 4:
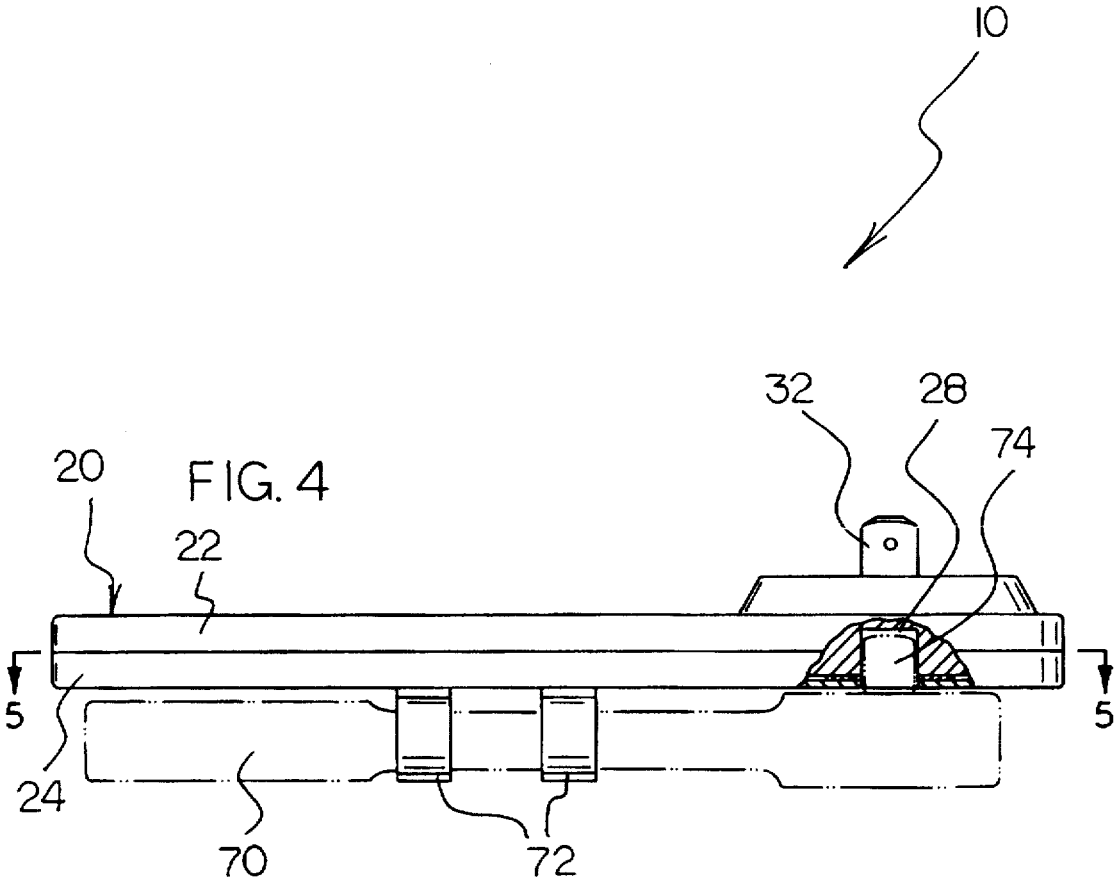
FIG. 4 is a side cut-away view of the auxiliary drive handle stored on the back portion of the handle.
Figure 5:
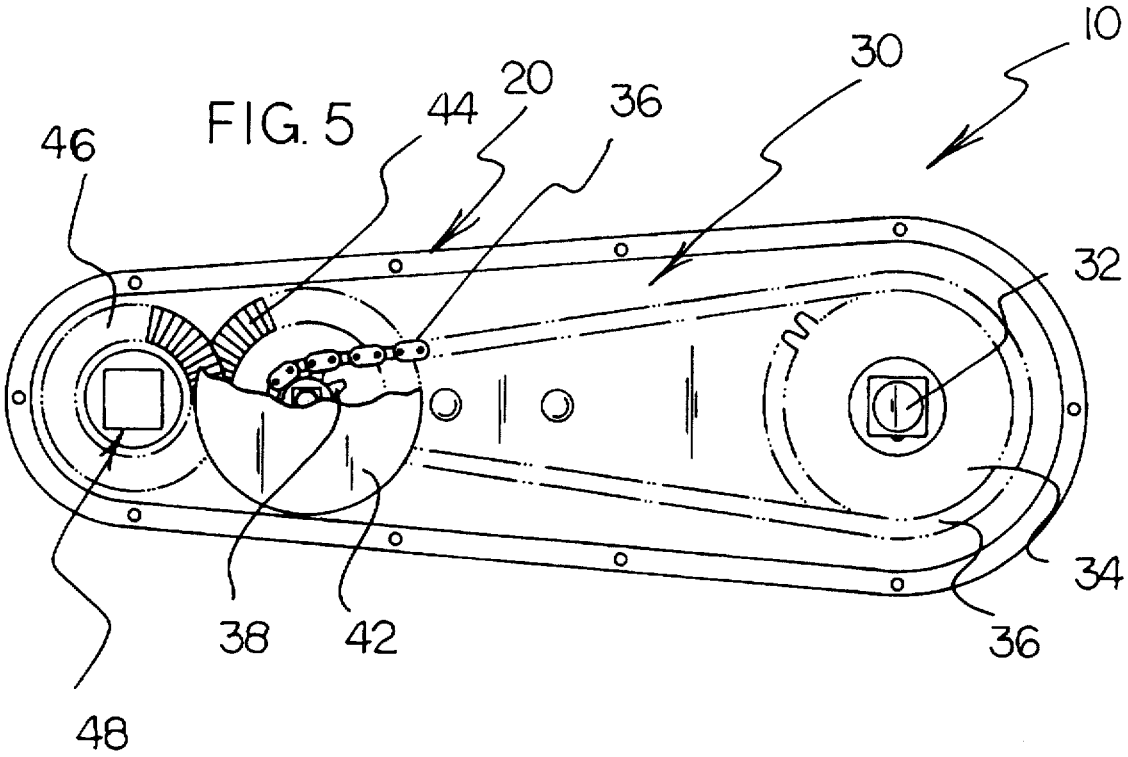
FIG. 5 is a cross sectional view taken along line 5—5 of FIG. 4 disclosing the drive means in connection with the extension means.
Figure 6:
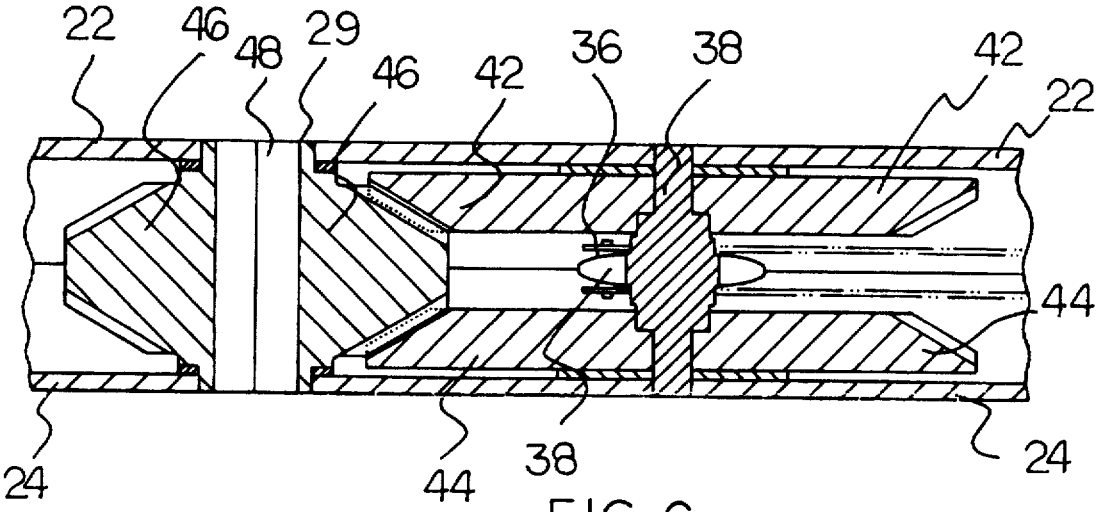
FIG. 6 is a cross sectional view taken along line 6—6 of FIG. 3 disclosing the extension means.

As best illustrated in FIGS. 1 through 6, it can be shown that the handle 20 includes a front member 22 formed in an elongated elliptical shape. A back member 24 is formed in a corresponding elongated elliptical shape, where said back member 24 is secured to the front member 22 forming an interior chamber for the drive means 30 and the extension means 40. The front member 22 includes a drive aperture 26 near the drive means 30 and a recess aperture 29 near the end opposite of the drive aperture 26 as best shown in FIG. 3 of the drawings. The back member 24 includes a storage aperture 28 near the end corresponding to the drive aperture 26 of the front member 22. The back member 24 further includes at least one holding spring clips 72 which removably retain the auxiliary handle. The drive means 30 includes a first sprocket 34 rotatably secured within the handle 20 near the drive aperture 26. A stud member 32 is centrally secured to the first sprocket 34 projecting outward through the drive aperture 26 as best shown in FIG. 5 of the drawings. A drive chain 36 engages the first sprocket 34. A second sprocket 38 is rotatably secured within the handle 20 near the recess aperture 29 as best shown in FIG. 3 of the drawings. The second sprocket 38 engages the drive chain 36 opposite of the first sprocket 34. The second sprocket's 38 radius is significantly lesser than the first sprocket's 34 radius providing increased torque to the stud member 32. The extension means 40 includes a first bevel gear 42 is centrally mounted to one side of the second sprocket 38 as best shown in FIG. 6 of the drawings. A second bevel gear 44 is centrally mounted to the side of the second sprocket 38 opposite of the first bevel gear 42 with the gears of the first bevel gear 42 and the second bevel gear 44 in aposition to one another. The diameter of the bevel gears 42 and 44 are equal. The diameter of the bevel gears 42 and 44 are substantially larger than the diameter of the second sprocket 38 allowing the dual sided bevel gear 46 to project between the bevel gears 42 and 44 without engaging the second sprocket 38. A dual sided bevel gear 46 is rotatably secured to handle 20 near the recess aperture 29. Said dual sided bevel gear 46 engages the first bevel gear 42 and the second bevel gear 44. The dual sided bevel gear 46 includes a drive recess 48 aligned to the recess aperture 29 receiving an auxiliary drive 74 from the auxiliary drive handle 70.

In use, a standard socket 12 is attached to the stud member 32. The user then projects the auxiliary drive 74 of the auxiliary drive handle 70 into the drive recess 48. The user then applies torque to the auxiliary drive handle 70 thereby rotating the dual sided bevel gear 46 which engages the bevel gears 42 and 44. The second sprocket 38 rotates engaging the drive chain 36 which rotates the first sprocket 34. The first sprocket 34 rotates the stud member 32 thereby rotating the standard socket 12 which rotates an unnumbered fastener. Alternatively, the user utilizes an unnumbered existing ratchet tool instead of the auxiliary drive handle 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A compound power socket wrench system comprising:

a handle structured to have an interior chamber for a drive means and an extension means, the handle further having a drive aperture near a first handle end and a recess aperture near the end opposite of the drive aperture;

a first sprocket rotatably secured within the handle near the drive aperture;

a socket drive centrally secured to the first sprocket, the socket drive projecting outward through the drive aperture;

a second sprocket rotatably secured within the handle near the recess aperture, the second sprocket having a radius smaller than a radius of the first sprocket;

a drive chain engaging the first sprocket and the second sprocket;

an extension means having a first bevel gear mounted to one side of the second sprocket, a second bevel gear mounted to the side of the second sprocket opposite of the first bevel gear with the gears of the first bevel gear and the second bevel gear in aposition to one another, a dual sided bevel gear rotatably secured to handle near the recess aperture, said dual sided bevel gear engages the first bevel gear and the second bevel gear, and the dual sided bevel gear includes a drive recess aligned to the recess aperture receiving an auxiliary drive from the auxiliary drive handle; and an auxiliary drive handle engaging the extension means.

2. A compound power socket wrench system comprising:

a handle formed in an elongated elliptical shape, the handle having a front member formed in an elongated elliptical shape, a back member formed in an elongated elliptical shape, said back member is secured to the front member forming an interior chamber for the drive means and the extension means, the front member includes a drive aperture near the drive means and a recess aperture near the end opposite of the drive aperture; and the back member includes a storage aperture near the end corresponding to the drive aperture of the front member, said back member further includes at least one holding spring clips which removably retain the auxiliary handle;

a first sprocket rotatably secured within the handle near the drive aperture;

a socket drive centrally secured to the first sprocket projecting outward through the drive aperture;

a drive chain engaging the first sprocket;

a second sprocket rotatably secured within the handle near the recess aperture, said second sprocket engages the drive chain opposite of the first sprocket where the second sprocket's radius is significantly lesser than the first sprocket's radius;

an extension means having a first bevel gear mounted to one side of the second sprocket, a second bevel gear mounted to the side of the second sprocket opposite of the first bevel gear with the gears of the first bevel gear and the second bevel gear in aposition to one another, a dual sided bevel gear rotatably secured to handle near the recess aperture, said dual sided bevel gear engages the first bevel gear and the second bevel gear, and the dual sided bevel gear includes a drive recess aligned to the recess aperture receiving an auxiliary drive from the auxiliary drive handle; and an auxiliary drive handle engaging the extension means.

* * * * *